US005157450A

United States Patent [19]

Kim

[11] Patent Number: 5,157,450

[45] Date of Patent: Oct. 20, 1992

[54] APPARATUS FOR REVERSELY TURNING COPIED SHEETS FOR A COPYING MACHINE

[75] Inventor: Jong K. Kim, Chungcheongnam, Rep. of Korea

[73] Assignee: Hyundai Electronics Inc. Co., Ltd., Kyeongki, Rep. of Korea

[21] Appl. No.: 608,434

[22] Filed: Nov. 2, 1990

[30] Foreign Application Priority Data

Nov. 21, 1989 [KR] Rep. of Korea ..... 16937 P 89

[51] Int. Cl.[5] ..... G03G 21/00

[52] U.S. Cl. ..... 355/321; 271/186

[58] Field of Search ..... 355/308, 309, 321, 318; 271/65, 186, 207, 224, 265, 269

[56] References Cited

U.S. PATENT DOCUMENTS

| | | | |
|---|---|---|---|
| 4,008,956 | 2/1977 | Stemmle | 355/309 |
| 4,155,643 | 5/1979 | Ladds et al. | 271/207 |
| 4,300,757 | 11/1981 | Koiso et al. | 271/207 |
| 4,671,503 | 6/1987 | Uemori | 271/65 |
| 4,828,248 | 5/1989 | Jackson et al. | 271/186 |

FOREIGN PATENT DOCUMENTS

| | | | |
|---|---|---|---|
| 0056456 | 5/1981 | Japan | 271/186 |
| 0194971 | 11/1984 | Japan | 271/207 |
| 0220676 | 9/1989 | Japan | 271/207 |

*Primary Examiner*—A. T. Grimley
*Assistant Examiner*—William J. Royer
*Attorney, Agent, or Firm*—Bradford E. Kile; Ruffin B. Cordell

[57] ABSTRACT

A copy sheet discharge apparatus for copying machines comprises a copy sheet guide plate fixed to the side of a cover and a copy sheet holding tray displaced below the sheet guide plate. With respect to this discharge apparatus, the image-bearing faces of copy sheets keep facing upwards while the copy sheets are delivered to the tray and the sheets are stacked into piles in the tray in the completed inversed state with the image-bearing face downwards, whereby the immediate checkup of the copy grade before being stacked in the tray is permitted and the cumbersome rearrangement of the order of the copy sheets after being removed from the tray is not needed.

9 Claims, 4 Drawing Sheets

APPARATUS FOR REVERSELY TURNING COPIED SHEETS FOR A COPYING MACHINE

BACKGROUND OF THE INVENTION

This invention relates to copy sheet discharge apparatus for use in electrophotographic appliances such as laser beam printers or copying machines (thereinafter referred to as copying machines) wherein immediate checkup of the image-bearing faces of copy sheets is made when the copy sheets are either under delivery to a copy holding tray or in stacked position in the copy sheet holding tray in the proper sequence of the original documents.

Two types of copying machines have been provided according to copy sheet discharging methods; one face-up type as shown in FIG. 1A and the other, face-down type as shown in FIG. 1B.

In the prior art face-up type copying machine as shown in FIG. 1A, the image on an original document on the document table is scanned by a scanning unit that includes exposure lamp and reflection mirror (not shown) and the scanned image beam is irradiated on the outer periphery of a photosensitive drum 3 through lens 1 and reflection mirror 2.

The photosensitive drum 3 has been charged with a predetermined potential by a charging means 4 before the image beam is irradiated thereon, thus forming an electrostatic latent image corresponding to the original document when irradiated by the image beam. The toner having been mixed with a developer in a developer reservoir 5 is applied to the electrostatic latent image, while copy sheets in a copy sheet holding cassette (not shown) are fed between the photosensitive drum 3 and a transfer means 6 through a sheet feed path 7.

The transfer means 6 then transfers the toner on the photosensitive drum 7 to the copy sheets.

The toner-transferred copy sheets are successively fed to and heated by a fusing roller set 8 comprising a heating roller 8A and a pressure roller 8B, and fused to the copy sheets. The toner remaining on the surface of the photosensitive drum 3 is removed by a cleaner 9. The copy sheets through the fusing roller set 8 are advanced by a feed roller set 10A and 10B and stacked into piles in a copy sheet holding tray 13 one over another. The copy sheet holding tray 13 is mounted adjacent to one side of upper and lower cover members 11 and 12.

This face-up type has the advantage of immediate checkup on the degree of copy that can be made when the copy sheets are either being delivered to a copy holding tray or stacked into piles in the copy holding tray. However, the disadvantage is that the stack of copy sheets has to be rearranged because the copy sheets are stacked in the reversed sequence of the original documents.

On the other hand, in the face-down type copying machine as shown in FIG. 1B, the copy sheet holding tray 13 is provided on the upper cover 11, and the copy sheets are fed to and stacked into piles in the copy sheet holding tray 13, with the image-bearing faces facing downwards. This face-down type copying machine has the advantage that the rearrangement of the stack of copy sheets is not required because the sheets are stacked in the same sequence as the original documents. However, the disadvantage is that the degree of copy cannot be checked up during the delivery of copy sheets to the copy holding tray. Therefore, after the copy process has been completed, it would be time-consuming to recopy the documents.

SUMMARY OF THE INVENTION

One object of the present invention is to provide a copy sheet discharge apparatus in which these disadvantages can be overcome.

Another object of the present invention is to provide a copy sheet discharge apparatus which can be applied to the conventional copying machine which has copy holdir g tray mounted either at the top or at the side of the machine.

A copy sheet discharge apparatus according to one aspect of the present invention comprises a sheet guide means for both permitting the immediate checkup of the copying grade from the outside and directing the image-bearing faces of the copy sheets, and a copy sheet holding tray for stacking the copy sheets having slidably passed the sheet guide means into piles in the proper sequence of the original documents.

The sheet guide means may be mounted in a downwardly or upwardly sloping position to the lower cover in the same direction as the sheet feed path.

An inversion-leading means may be mounted to the free end of the guide means for defining an inversion-leading guide, thereby copy paper of bad flexibility will be completely inverted.

Another aspect of the present invention is the mounting of the sheet discharge apparatus to the side of the copying machine which has an integrally formed cover mounted thereof with a feed path provided through the cover. This embodiment of the present invention also comprises a guide means which is mounted to the upper part of the side of the integral cover for permitting immediate checkup of the copy sheets while being guided thereby, and a copy sheet holding tray for stacking the copy sheets downwardly along the guide means into piles in the same sequence of the original documents.

Also in this embodiment of the present invention, the guide means may have an inversion-leading means mounted to the leading end thereof for defining an inversion-leading path therebetween, thus permitting complete inversion of copy paper of bad flexibility.

There are other objects and aspects of the present invention that will be apparent in the course of the following detailed description.

BRIEF DESCRIPTION OF DRAWINGS

The invention will now be described in detail with reference to the accompanying drawings wherein.

DESCRIPTION OF THE PREFERRED EMBODIMENTS

Figure 1A:
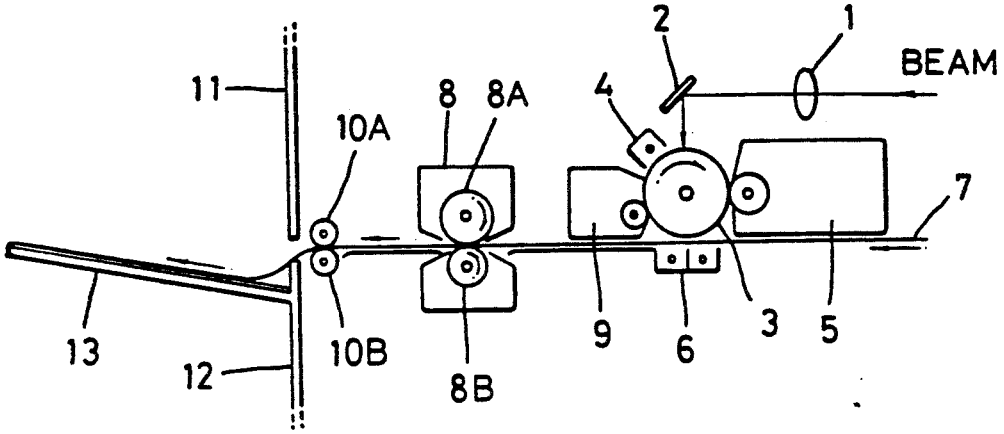
Fig. 1A PRIOR ART
FIGS. 1A and 1B are diagrammatical side views of the conventional copying machines.
Figure 1B:
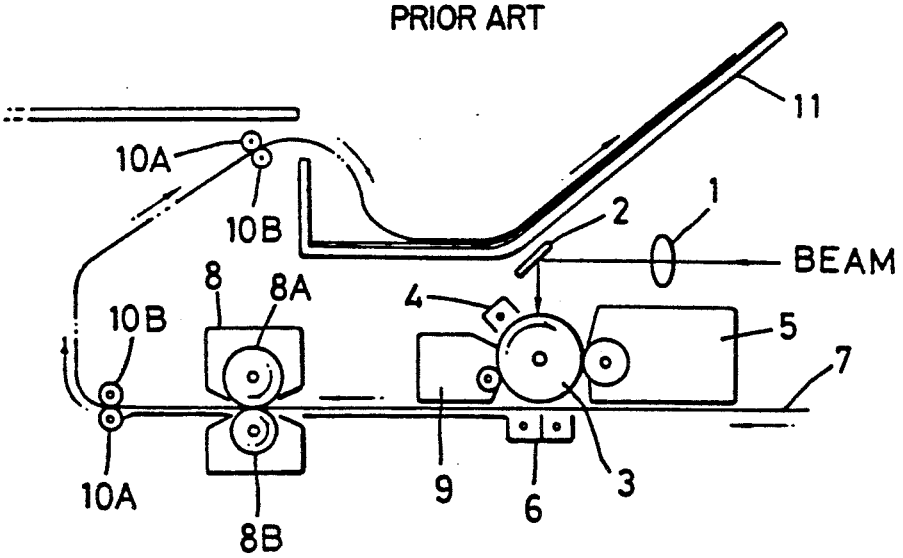
Fig. 1B PRIOR ART
Figure 2:
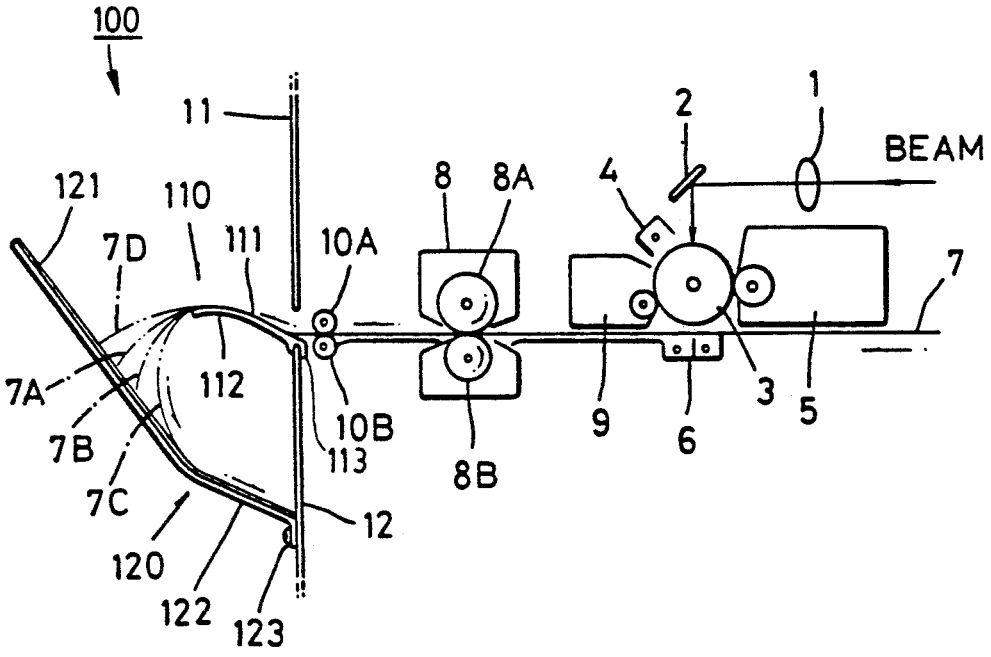
FIG. 2 is a diagrammatical side view of a copying machine emboding the copy sheet discharge apparatus of a first embodiment of this invention.

FIG. 2 shows a first embodiment of a sheet discharge apparatus 100 of this invention. In FIG. 2, lens 1, reflection mirror 2, photosensitive drum 3, charging means 4, developer reservoir 5, transfer means 6, sheet delivery path 7, fusing roller set 8, heating roller 8A, pressure roller 8B, cleaner 9 and feed roller set 10A and 10B are identical with those in FIGS. 1A and 1B as far as this invention is concerned and they are housed by upper and lower covers 11, 12. A copy sheet discharge apparatus 100 of this invention comprises a guide plate 110 and a copy holding tray 120 which are respectively anchored to the side of the lower cover 12 at 113 and 123.

The guide plate 110 is constructed in such a manner that it can inverse the copy sheets gradually while being guided thereby and stack the copy sheets into piles in the proper sequence of the original documents with the image-bearing faces downwards.

The guide plate 110 has an upwardly slanted section 111 and a downwardly curved section and an anchoring section 113.

The copy sheets advanced by the feed roller set 10A, 10B slide upwardly along the upwardly slanted guide section 111 and begin to bow downwardly from the leading ends thereof due to their own weight when passing through the downwardly curved section 112 with the image-bearing faces upwards. Due to the upward image-bearing face, the user can easily and immediately check up the copying grade.

The copy sheet holding tray 120 has a comparatively highly inclined upper section 121 and a slghtly inclined lower section 122 for facilitating an easy and correct inversion of the copy sheets.

Each of the downwardly bowed copy sheets passes through the downwardly curved section 112 and falls, beginning from the leading ends thereof, to the highly inclined upper section 121 by optionally following tracks 7A to 7D according to the grade of the flexibility thereof.

Having passed one of the tracks, each sheet abuts against the highly inclined upper section 121 at the leading end thereof and begins to bend toward the lower cover 12.

While following one of the tracks, the weight of the sheet is progressively biased downwards, thus causing the sheet to be gradually inversed. Thereby, the sheet has the leading end contact with the side face of the lower cover 12 and the rear end fall, due to its own resiliency, to the copy sheet holding tray 120.

In the aforementioned discharging process, the image-bearing face of each sheet keeps facing upwards while following the first track, which enables the user to check up the copy grade before the sheet is completely inversed.

The copy sheets are stacked, with the image-bearing faces downwards, into piles in the tray in the proper sequence of the original documents, whereby the time-consuming rearrangement of the order of the copy sheets is not required.

The inversion of the copy sheet while falling can be only made when a contact angle between the copy sheet and the highly inclined upper section 121 is more than 90 degrees. The flexibility of the common copy paper is more than 90 degrees and no essential problem is raised when the paper is used for copying.

Figure 3:
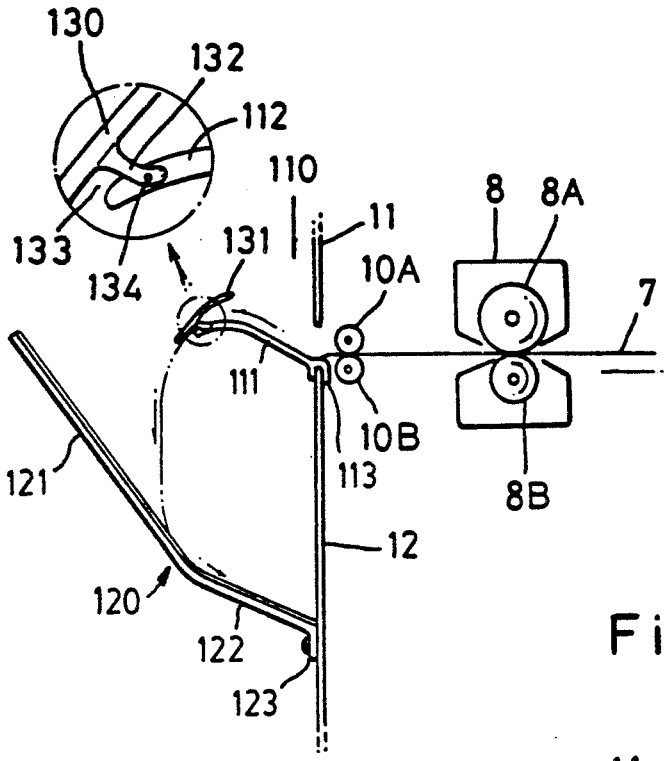
FIG. 3 is a partial side view of a second embodiment of this invention.

However, for the purpose of using transfer paper of bad flexibility for copying, another embodiment of the copy sheet discharge apparatus is provided as shown in FIG. 3 in which like parts are designated by like reference numerals in FIG. 2.

As shown, an auxiliary guide plate 130 as auxiliary inversion-guiding means comprises an upper slanted section 131 and lower attaching sections 132 which are provided under both sides of the upper slanted section 131 and fixedly but removably attached to the downwardly curved section 112 by screws 134.

An inversion-leading path is defined between the copy sheet guide means 110 and the auxiliary guide plate 130.

It will be apparent that the auxiliary guide plate 130 may be removed from the sheet inversion guide means 110 when using copy paper of good flexibility and may be attached to the guide means 110 when using copy paper of bad flexibility.

With this design, each copy sheet advanced by the feed roller set 10A, 10B slides upwardly along the sheet guide plate 110 and begins to bow downwardly through the guide-leading path 133. In other words, the copy sheet having slided upwardly along the upwardly slanted section 111 begins to be bent by the auxiliary guide plate 130 in contact with the auxiliary guide plate 130 and is further bent by passing the inversion-leading path 133.

Figure 4:
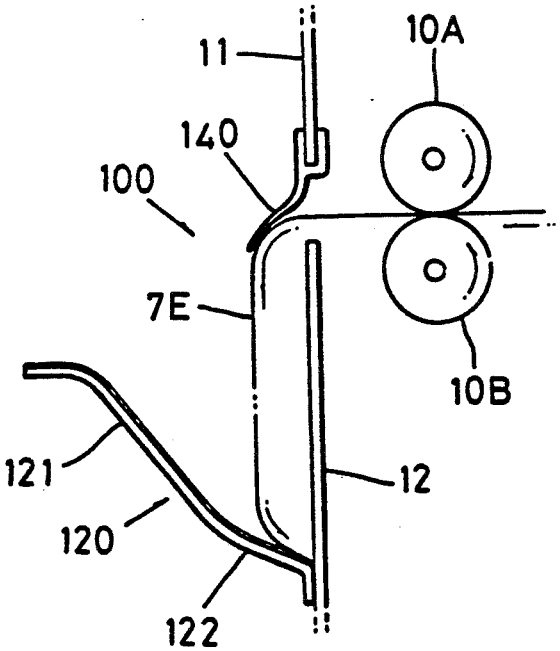
FIG. 4 is a partial side view of a third embodiment of this invention.

FIG. 4 is a third embodiment of the copy sheet discharge apparatus of the present invention. As shown, a guide plate 140 is attached to the lower end of the upper cover 11 and bent downwardly in respect of the feed path 7.

Each copy sheet advanced by the feed roller set 10A, 10B begins to be bent when the leading end thereof has contact with the guide plate 140 and is gradually inverted while falling along track 7E. Through track 7E, the sheet slides downwardly along the upper face of a lower curved section 122 and advances toward the side of the lower cover 12. As the rear end of the copy sheets are removed from the guide plate 110, the copy sheets, in the completely reversed position, are stacked into piles in the sequence of the original document.

Figure 5:
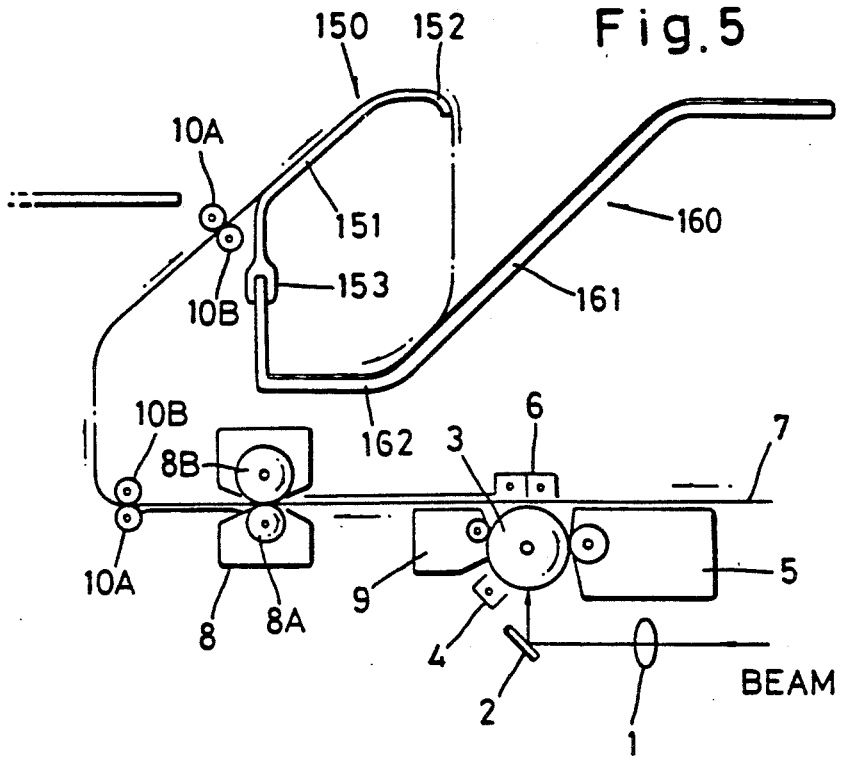
FIG. 5 is a partial side view of a fourth embodiment of this invention.

FIG. 5 shows another embodiment of the copy sheet discharge apparatus of the present invention, which may be applied to the copying machine having a copy sheet holding tray 160 thereon. As shown, a copy sheet holding tray 160 comprising a slanted section 161 and a horizontal section 162 is provided above the copying machine. A guide plate 150 comprising an upwardly slanted section 151 and a downwardly curved section 152 is fixed at 153 to the upper end of a copy sheet holding tray 160. The downwardly curved section 152 is bent toward the slanted face 161.

In this embodiment, each copy sheet advanced by the feed roller sets 10A, 10B is discharged upwardly by sliding along the upwardly slanted section 151 and begins to bend downwardly, due to its own weight, when the leading end reaches the downwardly curved section 152. Thereafter, the sheet falls to the slanted face 161 beginning from the leading end thereof and slides downwardly along the slanted face 161 as being inverted gradually. As the rear end of the copy sheets are removed from the downwardly curved section 152, the sheets in the inversed position are held in the tray one over another.

Also in this embodiment, when using copy paper of bad flexibility, the auxiliary inversion-leading means as shown in FIG. 3 may be mounted to the free end of the downwardly curved section 152.

Figure 6:
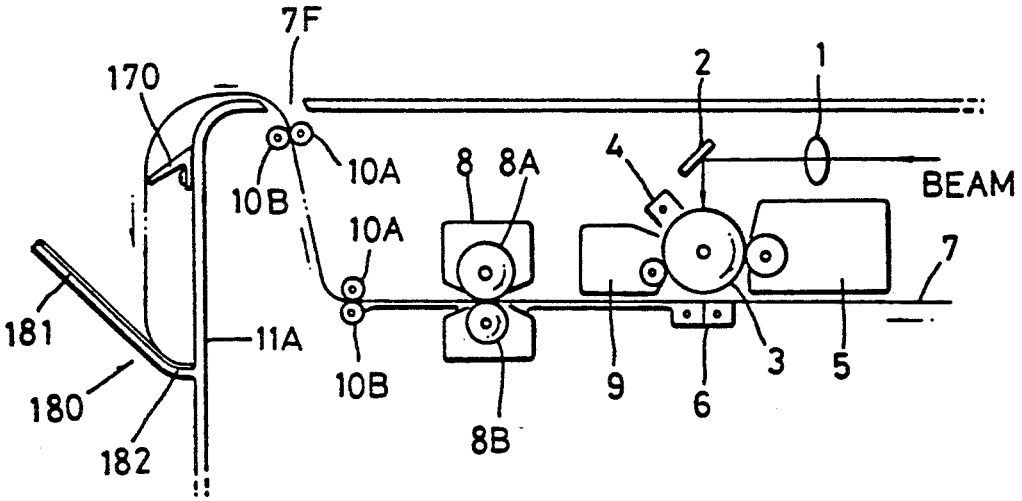
FIG. 6 is a fifth embodiment of this invention.

FIG. 6 shows the fifth embodiment of the sheet discharge apparatus of this invention which may be applied to a copying machine having a sheet discharge path 7F formed on a cover 11A, which is formed integrally with the copying machine.

In this embodiment, a slanted sheet guide means 170 and a copy sheet holding tray 180 which is disposed below the guide means 170 are extended from the side of the cover 11A.

Each copy sheet advanced by the feed roller set 10A, 10B is bent and begins to fall due to its own weight. The leading end thereof is spaced from the side face of the cover 11A with the distance corresponding to the extended height of the guide plate 170. Guided by the guide plate 170, the sheet falls directly downwards on the slanted face 181 formed contiguous to a slightly slanted portion 182 beginning from the leading end thereof and held in the tray 180 one over another with the image-bearing face downwards.

Before being completely inversed in the copy sheet holding tray 180, the image-bearing face of the sheet keeps facing upwards, which enables a user to check up the copying condition easily and immediately, thus eliminating the cumbersome rearrangement of the order of copy sheets after being removed from the copy holding tray 180.

Also in this embodiment, the auxiliary inversion-leading means in FIG. 3 may be mounted for proper inversion of transfer paper of bad flexibility.

As described above, in the copy sheet discharge apparatus of this invention for the copying machine, the copy sheets are inversed due to guide means, copy sheet holding tray, and the flexibility and weight of the sheet. The image-bearing face of the sheet keeps facing upwards before being completely inversed, for immediate and easy checkup of the copying grade by a user, then it is faced downwards in a stacked position in the tray to eliminate cumbersome rearrangement of the order of the copy sheets in order to conform to the proper sequence of the original documents.

In addition, the guide means is fixedly but removably attached to a cover or copy sheet holding tray so it may be applied to the conventional copying machine.

Having thus described in detail several embodiments of the sheet discharge apparatus incorporating the inventive concepts of the present invention herein, it will be realized that the present invention is susceptible to various modifications, arrangements, and combinations of parts thereof without drifting from the aforesaid concepts which are defined in the appended claims.

What is claimed is:

1. A copy sheet discharge apparatus in a copying machine for reversely turning copied sheets for said copying machine comprising:

guide means mounted to a lower cover of said copying machine for guiding said copied sheets and for allowing check on the recorded image on said copied sheets from the outside, said guide means being slanted upwardly with respect to a copied sheet delivery path; and sheet stacking means for stacking said copied sheets in the proper sequence of original documents, said sheet stacking means comprising a first slanted section of a comparatively high inclination angle and a second slanted section of a comparatively slight inclination angle.

2. An apparatus according to claim 1, wherein said guide means comprises an upwardly slanted section and a downwardly curved free end.

3. An apparatus according to claim 2, wherein said downwardly curved free end has an inversion-leading means mounted thereto for defining an inversion-leading path therebetween.

4. A copy sheet discharge apparatus in a copying machine for reversely turning copied sheets for said copying machine, said copying machine having an integrally formed cover above which a sheet discharge path is formed for feeding outwardly copy sheets advanced by a feed roller set, said apparatus comprising:

sheet guide means for guiding said copy sheets, which is mounted to the upper portion of one side of said integrally formed cover and being slanted downwardly, whereby the checkup of the copying grade can be made; and copy sheet holding means, which is displaced below said guide means, for receiving said copy sheets having slid downwardly and stacking said copy sheet into piles in the proper sequence of original documents.

5. An apparatus according to claim 4, wherein said guide means has an inversion-leading means mounted on the front end thereof for defining an inversion-leading path therebetween.

6. An apparatus according to claim 4, wherein said copy sheet holding means comprises a slanted section and a curved section.

7. A copy sheet discharge apparatus in a copying machine for reversely turning copied sheets for said copying machine, comprising:

guide means mounted to an upper cover of said machine for guiding said copied sheets and for allowing check on the recorded image on said copied sheets from the outside, said guide means being mounted in the opposite direction of a copied sheet delivery path; and sheet stacking means for stacking said copied sheets in the proper sequence of the original documents, said sheet stacking means comprising a first slanted section of a comparatively high inclination angle and a second slanted section of a comparatively slight inclination angle.

8. An apparatus according to claim 7, wherein a downwardly slanted section of a comparatively slight inclination angle is provided at the leading end of slanted section of said guide means.

9. An apparatus according to claims 7 or 8, wherein an auxiliary guide plate for guiding inversion of copied sheets is mounted at the leading end of said guide means, whereby an inversion guiding path is provided between said leading end of said guide means and said auxiliary guide plate.

* * * * *